US005873992A

United States Patent [19]

Glezen et al.

[11] Patent Number: 5,873,992

[45] Date of Patent: Feb. 23, 1999

[54] METHOD OF ELECTROPLATING A SUBSTRATE, AND PRODUCTS MADE THEREBY

[75] Inventors: John H. Glezen; Hameed A. Naseem; William D. Brown; Leonard W. Schaper; Ajay P. Malshe, all of Fayetteville, Ark.

[73] Assignee: The Board of Trustees of the University of Arkansas, Little Rock, Ark.

[21] Appl. No.: 824,077

[22] Filed: Mar. 24, 1997

Related U.S. Application Data

[63] Continuation of Ser. No. 424,879, Apr. 17, 1995, abandoned.

[51] Int. Cl.[6] ..... C25D 5/54; C25D 5/10; C25D 5/12; C25D 5/34

[52] U.S. Cl. ..... 205/159; 205/176; 205/178; 205/184; 205/186; 205/205; 205/209

[58] Field of Search ..... 205/102–105, 205/109–111, 149, 157, 159, 162–167, 169, 176, 178, 184, 186, 187, 209, 219

[56] References Cited

U.S. PATENT DOCUMENTS

| | | | |
|---|---|---|---|
| 3,515,649 | 6/1970 | Hepfer | 205/167 |
| 3,518,168 | 6/1970 | Byler | 205/219 |
| 3,549,507 | 12/1970 | Semienko et al. | 205/111 |
| 3,695,854 | 10/1972 | Egger et al. | 205/176 |
| 3,930,963 | 1/1976 | Polichette et al. | 205/159 |
| 3,982,235 | 9/1976 | Bennett et al. | 205/103 |
| 5,110,422 | 5/1992 | Alperine et al. | 205/159 |
| 5,190,796 | 3/1993 | Iacovangelo | 205/187 |
| 5,366,814 | 11/1994 | Yamanishi et al. | 205/111 |

OTHER PUBLICATIONS

"Low Cost, High Quality Electrolytic Plating. A method for controlling the electrolytic plating process lowers manufacturing costs and increases plating quality at the same time.", Michael Hurley and Stephen Boezi, Enthone–OMI, New Haven, Conn. *Electronic Packaging & Production* (Feb. 1994).

"Trends in High Density Plating. Modifications in electrolytic and electroless plating processes and an increasing use of additive technology meet the demands of high–density printed wiring boards.", C.T. Wang, Don Dinello and Steve S. Wagner, AT&T, Richmond, Va., *Electronic Packaging & Production*, (Nov. 1993).

"Processing and Performance of Gold MCM's", Todd A. Cloud, Michael R. Houston, Paul A. Kohl, *Member, IEEE and Sue Ann Bidstrup, IEEE Transactions On Components, Hybrids And Manufacturing Technology*, vol. 16, No. 7 (Nov. 1993).

"Metallizing CVD Diamond For Electronic Applications", C.D. Iacovangelo, E.C. Jerabek, Physical Chemistry Laboratory, GE Corporate Research and Development Center, Schenectady, N.Y., *ISHM '93 Proceedings*, (pp. 132–138). No month avaliable.

"Porosity Of Electroplated Palladium, Palladium–Nickel And Cobalt Hard Gold As A Function Of Substrate Roughness And Deposit Thickness", E.J. Kudrak, J.A. Abys and F. Humiec, AT&T Bell Laboratories, Murray Hill, NJ (pp. 379–386). No month available.

(List continued on next page.)

*Primary Examiner*—Arun S. Phasge
*Assistant Examiner*—Edna Wong
*Attorney, Agent, or Firm*—J.M. Mark Gilbreth; Robert W. Strozier; Gilbreth & Strozier, PC

[57] ABSTRACT

Disclosed is an electroplating method and products made therefrom, which in one embodiment includes using a current density $J_O$, to form a conductive metal layer having a surface roughness no greater than the surface roughness of the underlying member. In another embodiment of electroplating a substrate surface having peaks and valleys, the method includes electroplating a conductive metal onto the peaks to cover the peaks with the conductive metal, and into the valleys to substantially fill the valleys with the conductive metal.

12 Claims, 1 Drawing Sheet

OTHER PUBLICATIONS

"A New Operating Regime for Electroplating the Gold Absorber on X–Ray Masks", W.J. Dauksher, D.J. Resnick, W.A. Johnson and A.W. Yanof, Motorola, Inc., Tempe, Arizona, *Microelectronic Engineering*, 23 (1994) (pp. 235–238). No month available.

"A Versatile Non–Cyanide Gold Plating System", Ronald J. Morrissey, *Plating and Surface Finishing*, (Apr. 1993) (pp. 75–79).

Lupinski et al., "Plating on Plastics by a New Process", *Plating*, vol. 61, No. 5 (May 1974), pp. 429–431.

METHOD OF ELECTROPLATING A SUBSTRATE, AND PRODUCTS MADE THEREBY

This is a continuation of application Ser. No. 08/424,879 filed on Apr. 17, 1995 now abandoned.

BACKGROUND OF THE INVENTION

1. Field of the Invention

The present invention relates to methods of electroplating and to products made thereby. In another aspect, the present invention relates to methods of electroplating a conductive metal onto a substrate, and to products made thereby. In even another aspect, the present invention relates to methods of electroplating conductors onto a seed layer supported by a substrate, and to products made thereby. In still another aspect, the present invention relates to methods of electroplating conductors onto a seed layer supported by a diamond substrate, and to products made thereby.

2. Description of the Related Art

It is the physical and chemical properties of natural diamonds which render diamonds suitable for use in a wide range of applications. For example, natural diamonds are the hardest substance known and exhibit low friction and wear properties. Specifically, a natural diamond's thermal conductivity, thermal diffusivity properties, electrical resistivity and microhardness invite its substitution in various applications.

Specifically with respect to electronic applications, diamond, with a thermal conductivity four times that of copper and a dielectric constant less than alumina or aluminum nitride, has long been recognized as a desirable material for electronic substrates.

It is likewise believed that diamond films would find utility in a broad range of electronic uses.

Unfortunately, diamond films are not naturally occurring, but rather must be manufactured using any of a host of techniques.

Fortunately, however, the physical and chemical properties of synthetic diamond films have been found to be comparable to those of bulk diamond.

For example, it has been reported that electron assisted chemical vapor deposition films have electrical resistivities greater than $10^{13}$ Ω-cm, microhardness of about 10,000 HV, thermal conductivity of about 1100 W $m^{-1}$ $K^{-1}$, and thermal diffusivity of 200 to 300 $mm^2/s$. These compare favorably to those properties of natural diamond, i.e, resistivities in the range of $10^7$ to $10^{20}$ Ω-cm, microhardness in the range of 8,000 to 10,400 HV, thermal conductivity in the range of 900 to 2100 W $m^{-1}$ $K^{-1}$, and thermal diffusivity of 490 to 1150 $mm^2/s$. Thermal gravimetric analysis demonstrates the oxidation rates of diamond films in air are lower than those of natural diamond. Additionally, it is reported that the starting temperature of oxidation for microwave-assisted chemical vapor deposition diamond film is about 800° C., as evidenced by weight loss, while the morphology shows visible oxidation etching pits at temperatures as low as 600° C.

Thus, diamond films also show promise for finding utility in a multitude of applications, including electrical applications.

Currently, chemical vapor deposition diamond film has experienced limited market entry primarily as heat sinks for laser diodes. However, there are many other industrial uses planned for diamond film, virtually all of which require metallization.

For example, diamond film substrates have been hailed as the only solution to many of the thermal management problems currently encountered in the electronic and optoelectronics packaging area. As the packing density of electronic systems increases, this thermal management problem is only going to exacerbate. Metallization of diamond film substrates with highly conducting metals such as gold and copper is essential for these applications. Some of the applications which are in dire need of the development of a tenaciously adhering conducting metal film on a diamond substrate include laser diodes and diode arrays for telecommunications, power modules for on-board satellites, high powered microwave modules, MCMs, and especially 3-D MCMs.

However, while the industry is in dire need of a tenaciously adhering (>1 Kpsi on peel test) electroplated conducting metal film on a diamond substrate, the chemical inertness of diamond resists the formation of adherent coatings on it. This is especially true for large area (>1 mm×1 mm) diamond film substrates and thick metal films (>2 microns).

Presently, metallization is accomplished through some form of physical vapor deposition. While this produces a high quality film, it also produces high material cost due to its extreme waste of metal. Electroplating is preferable because is allows metal to be deposited selectively, which would cut waste by over 90% from what is consumed in a physical vapor deposition process.

Physical vapor deposition processes are currently the industry standard because films deposited by such processes tend not to blister or peel at high temperatures. In a physical vapor deposition process, the substrate is mounted inside a high vacuum chamber. The chamber is evacuated, and metal is either evaporated or sputtered to form a coating on the substrate. The inefficiency of the technique is due to the metal coating that is deposited onto the rest of the vacuum chamber at the same time. Only a small percentage of the metal that is consumed by the process lands on the substrate, with the rest being lost.

Electroplating would seem to be the proper candidate for metallizing diamond film with gold. With electroplating, the plated metal is applied directly to the target, resulting in much less waste as compared to physical vapor deposition. However, even though electroplating has established itself as a workhorse technology for cost effective thin film and foil fabrication in the electronics industry, only sputtering and evaporation of gold and copper have so far been commercially successfully utilized in metallizing diamond film substrates (and only on small substrates and only to small thicknesses).

"Metallizing CVD Diamond For Electronic Applications", Iacovangelo et al. International Journal of Microelectronics And Electronics Packaging, Vol. 17, No. 3, at 252–258 (1994), discloses a physical vapor deposition technique for depositing a gold layer onto a diamond film. As disclosed by Iacovangelo et al., thin gold films are applied to metal seed layers on diamond films by either a sputtering process or a chemical vapor deposition process.

As shown for coat numbers 11–13, the gold layers applied by the teachings of Iacovangelo et al. exhibit adhesion to the diamond substrate on the order of 4 to 10 Kpsi. Unfortunately, the gold layers produced by Iacovangelo et al were on the order of 0.5 microns thin, too thin for use in most applications.

Iacovangelo et al., further disclose the electroplating of a triple layer of copper, nickel and then gold onto a patterned thin film. However, as shown in FIG. 4 of Iacovangelo et al., this electroplated layer is on the order of 200 $\mu$m wide, far too narrow for many applications. Electroplating onto diamond film substrates on the order of 1 cm×1 cm or larger requires that the problems induced by thermal stress be solved.

Iacovangelo et al. do not disclose or teach how to electroplate onto larger diamond film substrates in a manner sufficient to overcome the problems induced by thermal stress. Biaxial stresses increase with increasing diamond film size.

Additional problems with applying metal layers to diamond films include blistering, peeling and delamination.

Therefore, there is a need in the art for a process for metallizing diamond and other types of substrates which does not suffer from one or more of the prior art limitations.

There is another need in the art for an electroplating process for metallizing diamond and other types of substrates which does not suffer from one or more of the prior art limitations.

There is even another need in the art for an electroplating process for metallizing diamond and other types of substrates which provides a product with suitable adhesion between the gold layer and the diamond film.

There is still another need in the art for an electroplating process for metallizing diamond and other types of substrates which provides a product with suitable surface roughness.

There is yet another a need in the art for metallized diamond and other types of substrates which do not suffer from the prior art limitations.

There is even still another need in the art for a metallized diamond and other types of substrates with suitable adhesion between the gold layer and the diamond film.

There is even yet another need in the art for a metallized diamond and other types of substrates with suitable surface roughness.

These and other needs in the art will become apparent to those of skill in the art upon review of this specification.

SUMMARY OF THE INVENTION

It is one object of the present invention to provide a process for metallizing diamond and other types of substrates which does not suffer from one or more of the prior art limitations.

It is another object to provide for an electroplating process for metallizing diamond and other types of substrates which does not suffer from one or more of the prior art limitations.

It is even another object to provide for an electroplating process for metallizing diamond and other types of substrates which provides a product with suitable adhesion between the gold layer and the diamond film.

It is still another object to provide for an electroplating process for metallizing diamond and other types of substrates which provides a product with suitable surface roughness.

It is yet another object to provide for metallized diamond and other types of substrates which do not suffer from the prior art limitations.

It is even still another object to provide for a metallized diamond and other types of substrates with suitable adhesion between the gold layer and the diamond film.

It is even yet another object to provide for a metallized diamond and other types of substrates with suitable surface roughness.

These and other objects of the present invention will become apparent to those of skill in the art upon review of this specification.

According to one embodiment of the present invention there is provided a method of electroplating an article having a surface with peaks and valleys, and articles made therefrom. The method generally includes electroplating a conductive metal onto the peaks to cover the peaks with the conductive metal, and into the valleys to substantially fill the valleys with the conductive metal.

According to another embodiment of the present invention there is provided a method of electroplating an article having a surface with a surface roughness, and articles made therefrom. The method generally includes electroplating a conductive metal onto the surface utilizing a current density less than or equal to $J_O$, to form a conductive metal layer having a surface roughness no greater than the article surface roughness.

According to even another embodiment of the present invention there is provided a method of electroplating an article comprising a supporting member and a seed layer supported by the supporting member, with the seed layer having a surface with peaks and valleys, and articles made therefrom. The method generally includes electroplating a conductive metal onto the peaks to cover the peaks with the conductive metal, and into the valleys to substantially fill the valleys with the conductive metal.

According to still another embodiment of the present invention there is provided a method of electroplating an article comprising a supporting member and a seed layer supported by the diamond member, with the seed layer having a surface with a surface roughness, and articles made therefrom. The method generally includes electroplating a conductive metal onto the seed layer surface utilizing a current density less than or equal to $J_O$, to form a conductive metal layer having a surface roughness no greater than the seed layer surface roughness.

According to yet another embodiment of the present invention there is provided a method of metallizing a diamond film, and articles made therefrom. The method generally includes a first step of applying a seed metal onto the diamond film to form a seed layer having a surface roughness, with the seed layer having a surface with peaks and valleys. The method further includes electroplating a conductive metal onto the peaks to cover the peaks with the conductive metal, and into the valleys to substantially fill the valleys with the conductive metal.

According to even still another embodiment of the present invention these is provided a method of metallizing a diamond film, and articles made therefrom. The method generally includes applying a seed metal onto the diamond film to form a seed layer, with the seed layer having a surface with a surface roughness. The method further includes electroplating a conductive metal onto the seed layer surface utilizing a current density less than or equal to $J_O$, to form a conductive metal layer having a surface roughness no greater than the seed layer surface roughness.

According to even yet another embodiment of the present invention there is provided a method of electroplating an article to form an electroplated layer having a desired surface roughness, and articles made therefrom. The method generally includes (a) electroplating at a current density, a conductive metal onto the article to form an electroplated layer. The method further includes (b) determining the surface roughness of the electroplated layer. The method still further includes increasing the current density of step (a) if the surface roughness determined in step (b) is less than the desired surface roughness, and decreasing the current density of step (a) if the surface roughness determined in step (b) is greater than the desired surface roughness. This method may be operated interatively until the desired surface roughness is obtained for the thickness required.

DETAILED DESCRIPTION OF THE INVENTION

Figure 1A:
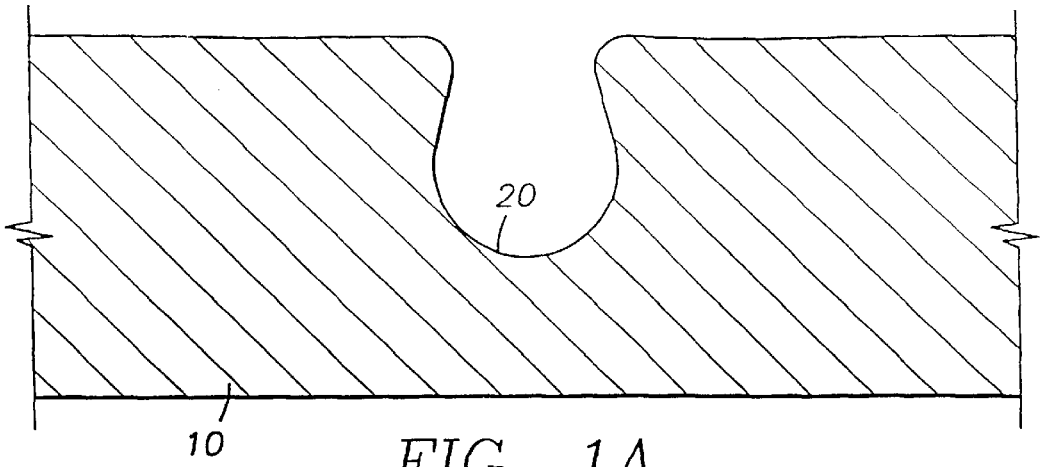
FIGS. 1A–C, show respectively, substrate 10 with irregularity 20 without an electroplated metal, substrate 10 with irregularity 20 electroplated over by electroplated metal 30, and substrate 10 with irregularity 20 electroplated substantially filled by electroplated metal 30.

The present invention provides a method for electroplating a conductive metal onto a target conductive metal layer surface, such that the formed electroplated metal layer will have a resulting surface roughness less than the initial surface roughness of the target layer.

The present invention also provides a method for electroplating a conductive metal onto a target conductive metal layer surface, such that the formed electroplated metal layer will have reduced likelihood of blistering away from the target layer at elevated temperatures, and will have good adhesion to the target layer.

The present invention generally includes a first step of metallizing a supporting substrate to form a seed layer, followed by electroplating a conductive layer onto the seed layer. Alternatively, the present invention may also be utilized to electroplate a conductive metal directly onto a conductive substrate even without a seed layer.

In the practice of the present invention, the substrate may comprise any material that will be suitable for the desired application. Non-limiting examples of supporting substrate materials include metals, diamond, semiconductors, ceramics, thermoplastics or thermosets.

Although much of the following description for the present invention makes reference to diamond film as the substrate, it is to be understood that this invention finds applicability to any type of substrate.

The diamond films utilized in the practice of the present invention are well known to those of skill in the art. The diamond films utilized in the present invention may be made by any suitable process. Generally, such suitable methods of making diamond films are generally characterized as chemical vapor deposition techniques such as hot filament, DC arcjet, RF arcjet, microwave plasma, and microwave plasma jet methods.

Initial treatment of the supporting substrate

In the practice of the present invention, the supporting substrate must generally be cleaned to provide a proper surface for metallizing. For example, with diamonds and many metals, such cleaning generally includes degreasing, removal of residual carbon, and the removal of the cleaning solutions.

For example, methods of cleaning a diamond film are well known to those of skill in the art, and any suitable method may be utilized. Degreasing is generally accomplished by boiling the diamond film in suitable chemical solvents, non limiting examples of which include trichloroethylene, acetone and alcohols. The removal of residual carbon is generally accomplished at slightly elevated temperatures utilizing an acid wash followed by a base wash. As a non limiting example, residual carbon may be removed using sulfuric acid/chromium trioxide at 160° C. followed by ammonium hydroxide/hydrogen peroxide at 70° C. Residuals of these cleaning solutions are then removed by subjecting the diamond film to ultrasonic cleaning in deionized water.

In some applications, it will be necessary that the surface roughness of the final electroplated conductive layer be quite low. For example, many electrical applications will require the final electroplated conductive layer have a surface roughness less than about 350 nm, preferably less than about 300 nm, and more preferably less than about 250 nm, and most preferably less than about 200 nm. Of course, it is to be understood that the present invention can be utilized to form a final electroplated conductive layer having almost any desired surface roughness.

The surface roughness of the underlying substrate will tend to influence the surface roughness of the final electroplated conductive layer. It is generally preferred to start with a substrate having a surface roughness near that desired in the final electroplated conductive layer. Likewise, the surface roughness of the seed layer on the substrate will also tend to influence the surface roughness of the final electroplated conductive layer. Thus, if a seed layer is utilized it is generally preferred to utilize one having a surface roughness near that desired in the final electroplated conductive layer.

Application of seed layer

Once the substrate is degreased and cleaned, the optional seed layer may be applied. Methods of applying a seed layer to a substrate, especially a diamond film are well known to those of skill in the art. In the practice of the present invention, the seed layer may be applied using any suitable technique. In general, physical vapor deposition methods are utilized to create the seed layers. Such techniques include sputtering techniques, thermal evaporation, and electron-beam evaporation, and are well known to those of skill in the art.

Apparatus for accomplishing physical vapor deposition are well known, and any suitable apparatus may be utilized in the practice of the present invention. Suitable equipment includes a standard thermal evaporator such as the Edwards E306A (Edwards Company, Great Britain) coating system.

According to the present invention, the seed layer may include one or more subsurface layers. Optionally, the seed layer may further include a top surface layer of the same metal as the metal to be electroplated onto the seed layer. Of course, any metal or material that will adhere to the supporting substrate, and provide a suitable surface for the electroplated metal may be utilized. Non-limiting examples of materials suitable for use as the seed layer(s) include aluminum, copper, chromium, gold, nickel, niobium, palladium, platinum, silicon, tantalum, titanium, tungsten, and combinations of any of the foregoing.

Titanium will tend to diffuse into gold. Therefore, if titanium is utilized as a subsurface seed layer, a layer of platinum or tungsten is generally utilized between the titanium and gold layers.

With some metals, the seed layer will tend to be susceptible to delamination unless the substrate is heated prior to and during the physical vapor deposition process. The temperature is generally great enough to discourage delamination of the final seed layer but less than the degradation temperature of the diamond film or the metal melting point, whichever is less. For example, generally during the physical vapor deposition process of depositing a chromium seed layer onto diamond film, the diamond film is heated to a temperature in the range of about 150° C. to about 400° C.

Preferably, the physical vapor deposition process is carried out at a temperature in the range of about 175° C. to about 300° C., and most preferably at a temperature in the range of about 185° C. to about 225° C.

While various operating pressures may be utilized, it is preferred that the physical vapor deposition process for applying the seed layer is generally carried out at near vacuum, on the order of about $6\times10^{-6}$ millibar or less, preferably on the order of about $1\times10^{-6}$ millibar or less. It is important that the vaporized chemical be thermally driven to the target in a relatively unimpeded manner. Thus, it is necessary to create proper conditions so that the vaporized chemical will have a high mean free path, on the order of a magnitude greater than the distance between the chemical target and the supporting substrate.

Generally, the vacuum chamber is purged with nitrogen prior to obtaining the vacuum, to remove substantially all oxidants.

In the practice of the present invention, the seed layer must have a relatively perfect crystal structure, which structure can be influenced by the application rate. Low seed layer application rates are utilized to provide a seed layer with the proper crystal structure. Suitable application rates are on the order of 5–10 Å/sec or lower.

Electroplating a conductive layer

Once the seed layer is in place, the conductive layer is applied onto the seed layers utilizing an electroplating technique.

The inventors have determined that electroplating at low electroplating rates, $R_L$, utilizing low electroplating current densities, $J_L$, will result in an electroplated layer having a surface roughness less than that of the underlying layer upon which it is electroplated, with roughness decreasing with decreasing $R_H$ and $J_H$. The inventors have also determined that electroplating at high electroplating rates, $R_H$, utilizing high electroplating current densities, $J_H$, will result in an electroplated layer having a surface roughness greater than that of the underlying layer upon which it is electroplated, with roughness increasing with increasing $R_H$ and $J_H$. An intermediate electroplating rate $R_O$, utilizing an intermediate current density $J_O$, such that $R_L<R_O<R_H$, and $J_L$, $J_O$, $J_H$, will result in an electroplated layer having a surface roughness equal to that of the underlying layer upon which it is electroplated.

The present invention thus provides a method of forming an electroplated layer having a surface roughness less than or equal to the surface roughness of the target layer, by utilizing an electroplating rate less than or equal to $R_O$, at intermediate current density less than or equal to $J_O$.

The present invention also provides a method of forming an electroplated layer having a target surface roughness by monitoring the roughness of the forming electroplated layer, and increasing the electroplating rate and current density above $R_O$ and $J_O$, if the monitored roughness is less than the target roughness, and by decreasing the electroplating rate and current density below $R_O$ and $J_O$ if the monitored roughness is greater than the target roughness.

The particular deposition rate or current density which will result in an electroplated layer having a roughness greater than, less than or equal to that of the layer upon which it is electroplated, will vary according to the type of metal being electroplated, the type of electroplating solution utilized, pH, solution density, bath temperature, anode-to-cathode ratio, type of agitation, as well as other factors. It is generally necessary to conduct a simple test over a range of deposition rates or current densities to determine $R_O$ and $J_O$, and the ranges for $R_L$, $J_L$, $R_H$ and $J_H$.

For example, when utilizing a certain commercially available gold plating solution, it is generally necessary to provide a current density at the anode of less than 1 mA/cm$^2$ to provide an electroplated layer having a surface roughness less than the roughness of the underlying layer. Preferably, the current density at the anode will be in the range of about 0.001 to about 0.095 mA/cm$^2$, more preferably in the range of about 0.01 to about 0.7 mA/cm$^2$, even more preferably in the range of about 0.1 to about 0.5 mA/cm$^2$, and most preferably in the range of about 0.1 to about 0.2 mA/cm$^2$, to provide an electroplated layer having a surface roughness less than the roughness of the underlying layer.

The surface of a substrate is not regular and may contain many irregularities, which may be naturally occurring, an unwanted result of processing or handling, or may intentionally manufactured into the substrate (such as vias). As used herein, the irregularity will be characterized as having a valley or low region, and peaks or high regions.

An alternative electroplating embodiment of the present invention includes electroplating a surface having surface irregularities such as crevices, cracks, grooves, exposed microcavities, scratches, slits, slots, openings, hollow portions, cavities, chambers, notches, pits, holes, vias, and/or voids. According to this alternative embodiment, the electroplating is conducted such that the surface irregularity is substantially filled by the electroplating process.

Figure 1B:
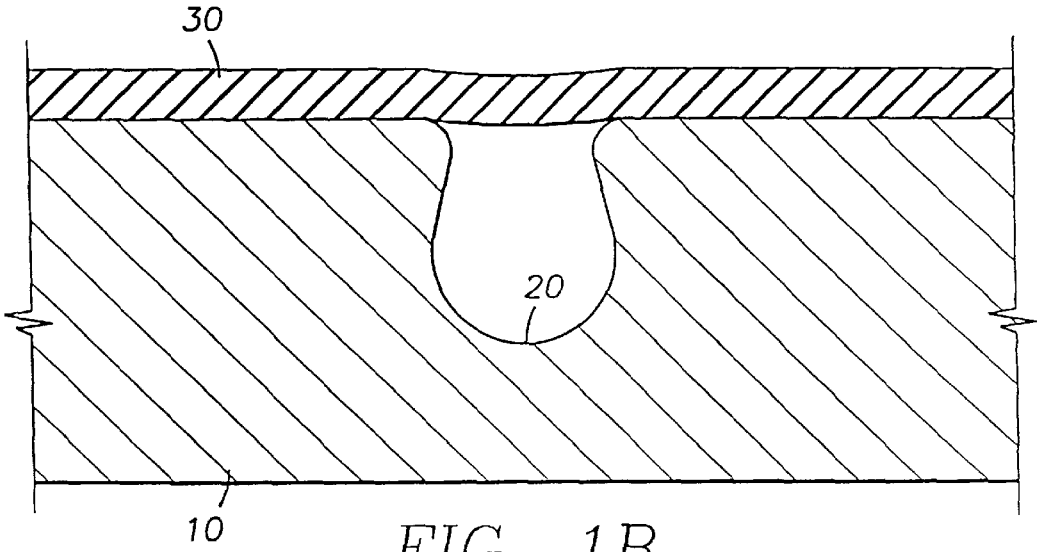
Figure 1C:
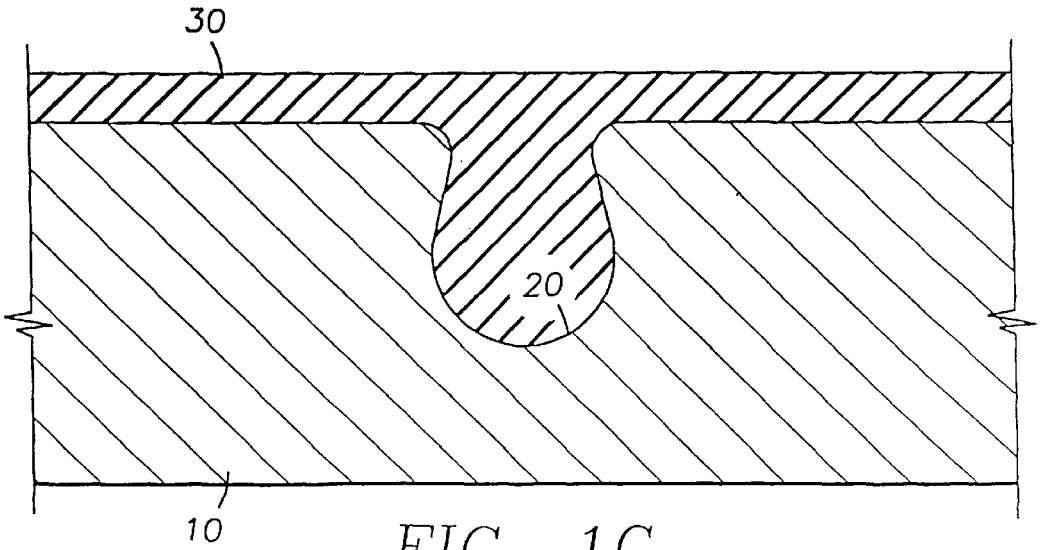

Reference is now made to FIGS. 1A–C, which show respectively, substrate 10 with irregularity 20 without an electroplated metal, substrate 10 with irregularity 20 electroplated over by electroplated metal 30, and substrate 10 with irregularity 20 substantially filled by electroplated metal 30.

While not wishing to be limited by theory the inventors believe that electroplating over irregularities, as shown in FIG. 1B will result in lower adhesion, and will provide trapped electroplating solvents which will boil at elevated temperatures and blister the article. The inventors also believe that the prior art electroplating methods generally would electroplate over any surface irregularities, because at higher current densities, the electroplating charge would accumulate at the surface of the substrate, at peaks, and be depleted at the bottom, or valley, of the irregularity. The inventors further believe that lower current densities allow for the metal to substantially fill the irregularity, resulting in better adhesion Thus, the present invention includes electroplating a surface having surface irregularities such as crevices, cracks, grooves, exposed microcavities, scratches, slits, slots, openings, hollow portions, cavities, chambers, notches, pits, holes, vias, and/or voids, to substantially fill substantially all of the irregularities with the electroplated metal.

Preferably the volume of an irregularity is at least 50 percent, more preferably at least 80 percent, even more preferably at least 90 percent and even more preferably at least 95 percent, still more preferably at least 98 percent, and most preferably at least 99 percent filled. Preferably at least 50 percent, more preferably at least 80 percent, even more preferably at least 90 percent and even more preferably at least 95 percent, still more preferably at least 98 percent, and most preferably at least 99 percent of the irregularities on the surface will be filled.

The proper electroplating rate can be easily determined by varying the electroplating rate over a range and analyzing the filling of the irregularities.

In the practice of the present invention, the electroplating is generally carried out as follows. The supporting member with seed layer is connected to a cathode and a platinum plate connected to the anode. With the supporting member and platinum plate submerged in an electroplating solution, a current is applied to drive the electroplating process.

The process of the present invention finds utility in providing useful products for use in electronic applications. The products of the present invention have utility in a broad range of electronic applications, including specifically as diodes, flat panel displays, power amplifiers, and as multichip modules in general.

EXAMPLES

The following non-limiting examples are provided to further illustrate the invention and are not meant to limit the invention in any manner. The following Procedures I–III discusses the general method of preparing metallized diamond film.

Procedure I

General Sample Preparation

The diamond samples utilized in the Examples were 1 cm×1 cm diamond film, produced by standard chemical vapor deposition ("CVD").

Degreasing the diamond film

The first step in sample preparation is degreasing, in which the diamond sample is sequentially boiled in trichloroethylene, acetone and then methanol.

The diamond sample is placed in 400 ml of trichloroethylene in a 600 ml Pyrex beaker. Next, the beaker is placed on a standard hot plate inside a fume hood. By means of the hot plate, the trichloroethylene is brought to a boil. After 15 minutes, the diamond film is removed from the boiling trichloroethylene. Unless otherwise specified, the diamond sample is always handled utilizing metal tweezers and holding the diamond by the edges.

The above procedures are next repeated with acetone. The diamond sample is placed in 400 ml of acetone in a 600 ml Pyrex beaker. Next, the beaker is placed on a standard hot plate inside a fume hood. By means of the hot plate, the acetone is brought to a boil. After 15 minutes, the diamond film is removed from the boiling acetone.

The above procedures are next repeated with methanol. The diamond sample is placed in 400 ml of methanol in a 600 ml Pyrex beaker. Next, the beaker is placed on a standard hot plate inside a fume hood. By means of the hot plate, the methanol is brought to a boil. After 15 minutes, the diamond film is removed from the boiling methanol.

Removal of residual carbon from the diamond film 1 gram of chromium trioxide powder is stirred into 400 ml of semiconductor grade sulfuric acid in a 600 ml Pyrex beaker. Next, the beaker is placed on a standard hot plate inside a fume hood. By means of the hot plate, the mixture of sulfuric acid/chromium trioxide powder is heated to 160° C. The diamond film is placed in the mixture for 30 minutes and then removed.

A similar procedure is repeated with a mixture of 200 ml of semiconductor grade ammonium hydroxide and 200 ml of hydrogen peroxide in a 600 ml Pyrex beaker. This beaker is placed on a standard hot plate inside a fume hood. By means of the hot plate, the mixture is heated to 70° C. The diamond film is placed in the mixture for 30 minutes and then removed.

Removal of residual cleaning solution

The diamond sample is placed in 600 ml of deionized water in a 600 ml Pyrex beaker. The beaker is then placed inside a standard ultrasonic cleaner, with the diamond sample subjected to ultrasonic cleaning for at least three hours.

Procedure II

Preparation of the seed layer

A seed layer was applied to the cleaned diamond film samples of Procedure I utilizing an Edwards E306A coating system. The Edwards E306A is a standard thermal evaporator, the operation of which is known to those of skill in the art, and which was operated generally as follows.

Mounting of the diamond film samples

After venting the vacuum chamber with nitrogen gas, the bell jar is removed. Removal of the bell jar provides access to and permits subsequent removal of the sample holder, i.e. the metal plate at the top of the apparatus under the jar. Next, one of the screws in the sample holder metal plate is loosened, and a corner of the diamond film sample is placed under the screw. The diamond sample is oriented such that the substrate side of the sample is against the plate, with the growth side of the sample facing out. The screw is then tightened until the washer is snug against the holder, sufficiently tight to secure the sample when the plate is held upside down. The sample holder is then placed in the evaporator. The piezoelectric holder is then placed in its standard position.

Mounting the chromium and gold targets

First, the center target holder, and two of the peripheral target holders on the target holding apparatus are loosened. Next, a standard thermal evaporation chromium stick, commercially available from R. D. Mathis Company, is positioned with one end in the center target holder, and the other end in one of the peripheral target holders. A standard thermal evaporation molybdenum boat, also commercially available from R. D. Mathis Company, is positioned with one end in the center target holder, and the other end in the other peripheral target holder. To encourage good electrical connections, a small metal shim is inserted between the molybdenum boat and washer of the center target holder, and the chromium holder is rotated until the chromium target is in electrical contact with the side electrode. Next, all the target holders are tightened to secure the chromium stick and the molybdenum boat. Finally, a small 2 mm×2 mm×2 mm nugget of gold of at least 99.99% purity is placed in the molybdenum boat.

Heater Adiustment

For proper operation, it is necessary that the radiant heater is pointed at the diamond film samples, that the thermocouple is close to the diamond film samples, but not shadowing any of them from the evaporating metal, and that the window on the radiant heater is clear and not covered with metal.

Pumpdown

The rotary pump is engaged to pump down the vacuum chamber until the Piranni gauge reads 0.06 mbar. Next, the diffusion pump is engaged and filled with liquid nitrogen. To protect the operator from exposure to the radiant heater, a cover is placed over the bell jar. The radiant heater is set to 200° C. and engaged. Over the next few hours, the diffusion pump is operated to take the pressure in the vacuum chamber down to 6E-6 mbar.

Thermal evaporation of the seed layer

The thermal evaporator is first operated to form a chromium layer directly on the diamond film, and then operated to form a gold layer on the chromium layer.

First utilizing the chromium stick as the target, the current is increased until a chromium deposition rate of 0.5 to 1.0 nm/sec is achieved, to form a chromium layer from 17.5 nm to 22.5 nm thick. Subsequently, the target holding apparatus is rotated so that the gold nugget in the molybdenum boat is now the target. The current is increased until a gold deposition rate of 0.5 to 1.0 nm/sec is achieved, to form a gold layer from 275 nm to 325 nm thick.

Once the chromium and gold layers are formed, the current is stopped, the substrate heater is turned off, the diffusion pump is disengaged, and the chamber is vented once. The chamber is pumped down again, but with the roughing pump instead of with the diffusion pump. The apparatus is then allowed to cool at room temperature for about an hour, at which time the chamber is again vented, and the seed layer coated diamond film removed.

Procedure III

Preparation of gold layer

Diamond film samples from Procedure II having a chromium and gold seed layer are utilized in this Example.

800 ml of a sulfite-based, non-toxic gold electroplating solution, available from Englehard is utilized in a 1500 ml Pyrex beaker. The solution must be tested to make sure its operational parameters are within tolerances. The pH, which must be between 10.5 and 11, is increased with KOH and decreased with DI water. The density, which must be between 12° Baume ("Be") and 16° Be, is increased with gold concentrate from Englehard, and decreased with DI water.

During the electroplating operation, the solution is agitated by means of a magnetic stir bar, and the solution temperature is maintained between 55° C. and 60° C. by means of an electrical hot plate.

The diamond sample is attached to the cathode alligator clip, and a platinum plate (2"×2") is attached to the anode alligator clip. Only about 5 $cm^2$ of the anode is placed into the solution. A standard HP power supply which provides current measurable to a tenth of a milliamp is utilized.

The electroplating is conducted at a current of 0.5 mA, which sets the current density at the cathode to 0.5 $mA/cm^2$, to provide a deposition rate of about 0.4 microns gold/hr. The electroplating is continued until the desired thickness of gold is obtained.

Procedure IV

Peel Test Procedure

The plated diamond films from Procedure III are tested using the "Peel Test" procedure of ASTM B-571 (11), except that an aluminum test strip is substituted for the steel or brass strip. The equipment utilized was a Sebastian III tester.

The non-electroplated (back) side of the diamond film is secured to an aluminum backplate using J. B. Weld epoxy. An aluminum pull strip is secured to the electroplated (front) side of the diamond film using J. B. Weld Epoxy. A metal clip is utilized to press the pull strip against the sample. The sample is then allowed to cure at 150° C. for 3 hours, and at room temperature for 21 hours. The Sebastian III tester is then utilized to provide a pulling force at a pulling angle 90° to the surface of the film, to pull the aluminum pull strip off of the diamond film. The digital display will indicate the force with which the machine was pulling when the pull strip was removed. By dividing this force value by the area of the pull strip, it can be reported in pounds per square inch.

Example 1

Control At High Deposit Rate

A 1 cm×1 cm diamond sample was coated with a seed layer of 200 Å chromium and 3000 Å gold by Procedures I and II as shown above. Seven gold layers were then applied at various current densities utilizing Procedure III above at the parameters as shown in Table 1 below.

TABLE 1

| Layer No. | Current Density ($mA/cm^2$) | Electroplating time (min) | Layer Thickness (μm) | Total Thickness (μm) | Deposit Rate (μm/hr) |
|---|---|---|---|---|---|
| 1 | 5.6 | 0.5 | 0.3 | 0.3 | 36 |
| 2 | 5 | 1 | 0.4 | 0.7 | 24 |
| 3 | 10 | 2 | 0.8 | 1.5 | 24 |
| 4 | 10 | 2 | 0.5 | 2.0 | 15 |
| 5 | 10 | 4 | 1.0 | 3.0 | 15 |
| 6 | 10 | 2 | 0.5 | 3.5 | 15 |
| 7 | 10 | 2 | 0.5 | 4.0 | 15 |

Peel Test of Procedure IV was conducted on the above 7 layer sample: sample peeled at 20 pounds (350 psi).

Example 2

Control At High Deposit Rate

A 1 cm×1 cm diamond sample was coated with a seed layer of 200 Å chromium and 3000 Å gold by Procedures I and II as shown above. A 4.5 μm gold layer was applied at a deposition rate of 18 μm/hr utilizing Procedure III. Peel Test results utilizing Procedure IV was as follows: peeled at 25 bs (440 psi).

Example 3

Roughness vs. Deposit Rate

Two 1 cm×1 cm diamond samples "A" an "B" were each coated with a seed layer of 200 Å chromium and 3000 Å gold by Procedures I and II as shown above. Eight layers of gold were then deposited on each seed layer by Procedure III above, with surface roughness measured initially and after deposition of each gold layer. Results are presented in Table 2.

TABLE 2

| Cumulative layer thickness (μm) | Current Density at anode ($mA/cm^2$) | Deposition rate (μm/hr) | Roughness (nm) |
|---|---|---|---|
| SAMPLE "A" | | | |
| 0 | N/A | N/A | 150 |
| 1.3 | 5 | 20 | 350 |
| 1.6 | 0.5 | 0.1 | 232 |
| 1.9 | 0.5 | 0.1 | 200 |
| 2.0 | 0.5 | 0.05 | 187 |
| 2.2 | 0.5 | 0.07 | 162 |
| 2.3 | 0.5 | 0.05 | 140 |
| 4.0 | 1.8 | 0.6 | 221 |
| SAMPLE "B" | | | |
| 0 | N/A | N/A | 145 |
| 1.3 | 5 | 20 | 350 |
| 1.6 | 0.5 | 0.1 | 240 |
| 1.9 | 0.5 | 0.1 | 246 |
| 2.0 | 0.5 | 0.05 | 212 |
| 2.2 | 0.5 | 0.07 | 180 |
| 2.3 | 0.5 | 0.05 | 190 |
| 4.0 | 1.8 | 0.6 | 230 |

Example 4

Annealing of seed layer 3 1 cm×1 cm diamond samples "C" were each coated with a seed layer of 200 Å chromium and 3000 Å gold by Procedures I and II as shown above. 3 1 cm×1 cm diamond samples "D" were each coated with a seed layer of 200 Å chromium and 1000 Å gold by Procedures I and II as shown above, and an additional 2000 Å gold by Procedures I and II as shown above, except that an deposition temperature of 50° C. was utilized.

For samples C-1 and D-1, the seed layer was not annealed, for sample C-2 and D-2, the seed layer was annealed at 300° C., and for samples C-3 and D-3, the seed layer was annealed at 400° C. All samples were then electroplated with a 5 Å thick gold layer at 0.8 mA/cm$^2$ by Procedure III above.

These six electroplated samples were all subjected to annealing at 350° C. Finally, all samples were subjected to the Peel Test of Procedure IV. Results are shown in the following Tables 3–6.

TABLE 3

| Surface Roughness Of Seed Layer Before Electroplating (nm) | | |
|---|---|---|
| | SAMPLES C | SAMPLES D |
| 1 (SEED LAYER NOT ANNEALED) | 250 | 250 |
| 2 (SEED LAYER ANNEALED AT 300° C.) | 254 | 269 |
| 3 (SEED LAYER ANNEALED AT 400° C.) | 262 | 288 |

TABLE 4

| Surface Roughness Of Electroplated Gold Layer (nm) | | |
|---|---|---|
| | SAMPLES C | SAMPLES D |
| 1 (SEED LAYER NOT ANNEALED) | 181 | 206 |
| 2 (SEED LAYER ANNEALED AT 300° C.) | 183 | 233 |
| 3 (SEED LAYER ANNEALED AT 400° C.) | 150 | 207 |

TABLE 5

| Surface Roughness Of Electroplated Gold Layer - After Annealing At 350° C. (nm) | | |
|---|---|---|
| | SAMPLES C | SAMPLES D |
| 1 (SEED LAYER NOT ANNEALED) | 180 | 213 |
| 2 (SEED LAYER ANNEALED AT 300° C.) | 180 | 230 |
| 3 (SEED LAYER ANNEALED AT 400° C.) | 250 | 450 |

Samples in the bottom row blistered, accounting for the high surface roughness.

TABLE 6

| Peel Test Results (PSI) | | |
|---|---|---|
| | SAMPLES C | SAMPLES D |
| 1 SEED LAYER NOT ANNEALED) | 2400 (epoxy broke) | 2900 |
| 2 (SEED LAYER ANNEALED AT 300° C.) | 2900 (limit of peel tester) | 2900 |

TABLE 6-continued

| Peel Test Results (PSI) | | |
|---|---|---|
| | SAMPLES C | SAMPLES D |
| 3 (SEED LAYER ANNEALED AT 400° C.) | 33 | 0 |

Example 5

Thermal Stress and Thermal Cycling Of Large Samples (21 mm×21 mm)

21 mm×21 mm samples were each coated with a seed layer of 200 Å chromium and 3000 Å gold by Procedures I and II as shown above. Seed layers were subjected to no annealing, annealing at 350° C., or annealing at 400° C. A gold layer of 5 Å was then deposited on the seed layer of each sample by Procedure III above. One set of samples was then subjected to thermal stress (annealing) at 350° C. or 400° C. for 30 minutes. Another set of samples was then subjected to thermal cycling from 150° C. to −65° C., in close agreement with military standards. The samples were subjected to 16 cycles, with a cycle as follows: climbing to 150° C. in 15 minutes, dwell for 15 minutes, down to −65° in 15 minutes, dwell for 15 minutes. This procedure varied from standard military specifications in that 15 minute temperature increments were utilized instead of 10 minute increments.

TABLE 7

| Peel Testing After Thermal Cycling (PSI) | | |
|---|---|---|
| | SAMPLES For Thermal Stress | SAMPLES For Thermal Cycling |
| 1 (SEED LAYER NOT ANNEALED) | 350° C.: 3600<br>400° C.: 2000 | 3600 |
| 2 (SEED LAYER ANNEALED AT 300° C.) | 350° C.: 3600<br>400° C.: 1800 | 3600 |
| 3 (SEED LAYER ANNEALED AT 400° C.) | 350° C.: 0 | 0 |

Example 6

21 mm×21 mm samples of diamond were degreased and cleaned according to Procedure I above. The teachings of Procedure II were followed to deposit the seed layer, except that the thickness of chromium was always 300 angstroms, and copper was deposited instead of gold. The copper was deposited to a thickness of 2000 angstroms, but at varying substrate temperatures. Also, the base pressure in the thermal evaporator chamber was varied. Also, the temperature of the seed layer anneal step was varied. All of the samples were then electroplated with cooper to a thickness of 8–10 microns. All of the samples were then annealed at 350° C. All of the samples were then observed for blisters.

TABLE 8

| SAMPLE | EVAPORATION SUBSTRATE TEMPERATURE (°C.) | EVAPORATION BASE PRESSURE (MBAR) | SEED LAYER ANNEAL TEMPERATURE (°C.) | BLISTER RATING |
|---|---|---|---|---|
| 1 | 200 | 1.3E-6 | AMBIENT | MEDIUM |
| 2 | 200 | 1.3E-6 | 300 | MEDIUM |
| 3 | 200 | 1.3E-6 | 400 | MEDIUM |
| 4 | Cr: 200<br>Cu: 50 | 1.3E-6<br>1.5E-7 | AMBIENT | LOW |
| 5 | Cr: 200<br>Cu: 50 | 1.3E-6<br>1.5E-7 | 300 | LOW |
| 6 | Cr: 200<br>Cu: 50 | 1.3E-6<br>1.5E-7 | 400 | VERY LOW |
| 7 | Cr: 200<br>Cu: 50 | 1.3E-6<br>1.5E-7 | AMBIENT | HIGH |
| 8 | Cr: 200<br>Cu: 50 | 1.3E-6<br>1.5E-7 | 300 | HIGH |
| 9 | Cr: 200<br>Cu: 50 | 1.3E-6<br>1.5E-7 | 400 | N/A<br>(etched off) |

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled the art to which this invention pertains.

we claim:

1. A method of electroplating an article having a condutive surface with peaks and valleys of initial surface roughness $R_O$, the method comprising:

cleaning the conductive surface; and electroplating a conductive metal onto the peaks to cover the peaks with the conductive metal, and into the valleys to substantially fill the valleys with the conductive metal to form an electroplated article having a surface roughness $R_E$, wherein the electroplating is carried out at a current density less than or equal to $J_O$;

wherein $J_O$ is a current density which will result in the electroplated article having a surface roughness $R_E$ equal to $R_O$;

wherein the article comprises a supporting member and a seed layer;

wherein the supporting member comprises diamond, and the seed layer comprises chromium and gold, and the conducting metal comprises gold; and wherein the chromium is adhered to the diamond.

2. A method of electroplating an article having a conductive surface with a surface roughness $R_O$, the method comprising:

cleaning the conductive surface; and electroplating a conductive metal onto the surface utilizing a current density less than or equal to $J_O$, to form a conductive metal layer having a surface roughness $R_E$ no greater than the article surface roughness $R_O$;

wherein $J_O$ is a current density which will result in the conductive metal layer having a surface roughness $R_E$ equal to $R_O$.

wherein the article comprises a supporting member and a seed layer:

wherein the supporting member comprises diamond, and the seed layer comprises chromium and gold, and the conducting metal comprises gold; and wherein the chromium is adhered to the diamond.

3. A method of electroplating an article comprising a supporting member and a seed layer supported by the supporting member, with the seed layer having a conductive surface with peaks and valleys of initial surface roughness $R_O$, the method comprising:

cleaning the conductive surface; and electroplating a conductive metal onto the peaks to cover the peaks with the conductive metal and into the valleys to substantially fill the valleys with the conductive metal, to form an electroplated article having a surface roughness $R_E$ wherein the electroplating is carried out at a current density less than or equal to $J_O$;

wherein $J_O$ is a current density which will result in the conductive metal layer having a surface roughness $R_E$ equal to $R_O$, wherein the article comprises a supporting member and a seed layer;

wherein the supporting member comprises diamond, and the seed layer comprises chromium and gold, and the conducting metal comprises gold; and wherein the chromium is adhered to the diamond.

4. A method of electroplating an article comprising a diamond member and a seed layer supported by the diamond member, with the seed layer having a conducting surface with a surface roughness $R_O$, the method comprising cleaning the conductive surface; and electroplating a conductive metal onto the seed layer surface utilizing a current density less than or equal to $J_O$, to form a conductive metal layer having a surface roughness no greater than the seed layer surface roughness $R_O$;

wherein $J_O$ is a current density which will result in the conductive metal layer having a surface roughness $R_E$ equal to $R_O$.

wherein the article comprises a supporting member and a seed layer;

wherein the seed layer comprises chromium and gold, and the conducting metal comprises gold; and wherein the chromium is adhered to the diamond.

5. A method of metallizing a diamond film comprising:

a applying a seed metal onto the diamond film to form a seed layer having a surface roughness $R_O$, with the seed layer having a conductive surface with peaks and valleys;

(b) cleaning the conductive surface; and (c) electroplating a conductive metal onto the peaks to cover the peaks with the conductive metal, and into the valleys to substantially fill the valleys with the conductive metal, to form an electroplated article having a surface roughness $R_E$, wherein the electroplating is carried out at a current density less than or equal to $J_O$;

wherein $J_O$ is a current density which will result in the electroplated article having a surface roughness $R_E$ equal to $R_O$, wherein the seed metal comprises chromium, and the diamond film is heated to a temperature in the range of about 150° C. to about 400° C. prior to applying the chromium.

6. The method of claim 5 wherein the seed metal further comprises gold.

7. The method of claim 6 wherein the conductive metal comprises gold.

8. The method of claim 7 wherein the electroplating is conducted at a current density in the range of about 0.001 to about 0.095 $mA/cm^2$.

9. A method of metallizing a diamond film comprising:

(a) applying a seed metal onto the diamond film to form a seed layer, with the seed layer having a conductive surface with a surface roughness $R_O$; and (b) electroplating a conductive metal onto the seed layer surface utilizing a current density less than or equal to $J_O$, to form a conductive metal layer having a surface roughness $R_E$ no greater than the seed layer surface roughness $R_O$;

wherein $J_O$ is a current density which will result in the electroplated article having a surface roughness $R_E$ equal to $R_O$;

wherein the seed metal comprises chromium, and the diamond film is heated to a temperature in the range of about 150° C. to about 400° C. prior to applying the chromium.

10. The method of claim 9 wherein the seed metal further comprises gold.

11. The method of claim 10 wherein the conductive metal comprises gold.

12. The method of claim 11 wherein the electroplating is conducted at a current density in the range of about 0.001 to about 0.095 $mA/cm^2$.

* * * * *